US010851750B2

(12) United States Patent
Landenberger

(10) Patent No.: US 10,851,750 B2
(45) Date of Patent: Dec. 1, 2020

(54) ELECTROMAGNETICALLY ACTUATABLE INLET VALVE AND HIGH-PRESSURE PUMP HAVING AN INLET VALVE

(71) Applicant: Robert Bosch GmbH, Stuttgart (DE)

(72) Inventor: Tobias Landenberger, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 150 days.

(21) Appl. No.: 16/060,293

(22) PCT Filed: Oct. 31, 2016

(86) PCT No.: PCT/EP2016/076188
§ 371 (c)(1),
(2) Date: Jun. 7, 2018

(87) PCT Pub. No.: WO2017/097498
PCT Pub. Date: Jun. 15, 2017

(65) Prior Publication Data

US 2018/0355830 A1 Dec. 13, 2018

(30) Foreign Application Priority Data

Dec. 7, 2015 (DE) ..... 10 2015 224 421

(51) Int. Cl.
*F02M 59/36* (2006.01)
*F04B 7/00* (2006.01)
(Continued)

(52) U.S. Cl.
CPC ..... *F02M 59/366* (2013.01); *F04B 1/0452* (2013.01); *F04B 7/0076* (2013.01);
(Continued)

(58) Field of Classification Search
CPC ... F02M 2200/8053; F02M 2200/8084; F02M 59/06; F02M 59/102;
(Continued)

(56) References Cited

U.S. PATENT DOCUMENTS 2,574,762 A * 11/1951 Schell ..... H01F 7/088 335/245
3,379,214 A * 4/1968 Weinberg ..... F16K 31/082 137/625.5
(Continued)

FOREIGN PATENT DOCUMENTS

DE 10016600 5/2001
DE 102004004708 4/2005
(Continued)

OTHER PUBLICATIONS

International Search Report for Application No. PCT/EP2016/076188 dated Jan. 4, 2017 (English Translation, 3 pages).
(Continued)

*Primary Examiner* — John M Zaleskas
(74) *Attorney, Agent, or Firm* — Michael Best & Friedrich LLP

(57) ABSTRACT

The invention proposes an electromagnetically actuatable inlet valve (24) for a high-pressure pump, in particular of a fuel-injection system. The inlet valve (24) has a valve member (34) which can be moved between and open position and a closed position. An electromagnetic actuator (60) is provided, by means of which the valve member (34) can be moved, wherein the electromagnetic actuator (60) has an armature (68) which acts at least indirectly on the valve member (34), a magnet coil (64) which surrounds the armature (68), and a magnetic core (66) against which the armature (68) comes to rest at least indirectly when current is applied to the magnet coil (64), wherein the armature (68) is movably guided in a carrier element (78), and the carrier element (78) and the magnetic core (66) are interconnected. The carrier element (78) and the magnetic core (66) are interconnected by a sleeve-shaped connection element (90) which is integrally bonded in a first connection region (92) to the carrier element (78) and/or the magnetic core (66), and
(Continued)

interlockingly engages the carrier element and/or the magnetic core in a second connection region (94) offset relative to the first connection region (92) in the direction of the longitudinal axis (91) of the connection element (90).

21 Claims, 3 Drawing Sheets

(51) Int. Cl.

| | |
|---|---|
| ***F04B 53/10*** | (2006.01) |
| ***H01F 7/16*** | (2006.01) |
| ***F04B 1/04*** | (2020.01) |
| ***F04B 1/0452*** | (2020.01) |
| *F02M 63/02* | (2006.01) |
| *F02M 59/06* | (2006.01) |
| *F02M 59/10* | (2006.01) |

(52) U.S. Cl.
CPC ..... *F04B 53/102* (2013.01); *F04B 53/1082* (2013.01); *H01F 7/1607* (2013.01); *F02M 59/06* (2013.01); *F02M 59/102* (2013.01); *F02M 63/0265* (2013.01); *F02M 2200/8053* (2013.01); *F02M 2200/8084* (2013.01)

(58) Field of Classification Search
CPC .. F02M 59/366–59/368; F02M 59/466; F02M 63/0265; F04B 1/0452; F04B 7/0076; F04B 53/1082; F16K 31/0655; H01F 7/1607
See application file for complete search history.

(56) References Cited

U.S. PATENT DOCUMENTS

| | | | | |
|---|---|---|---|---|
| 4,538,129 | A | 8/1985 | Fisher | |
| 6,659,421 | B1 * | 12/2003 | Goossens | B60T 8/363 251/129.02 |
| 6,742,764 | B1 * | 6/2004 | Volz | B60T 8/363 251/129.02 |
| 6,776,391 | B1 * | 8/2004 | Goossens | B60T 8/363 251/129.15 |
| 2003/0038637 | A1 | 2/2003 | Bertness et al. | |
| 2004/0223856 | A1 * | 11/2004 | Rembold | F02M 59/366 417/222.2 |
| 2005/0166979 | A1 * | 8/2005 | Berger | F23N 1/005 137/630.15 |
| 2005/0173979 | A1 * | 8/2005 | Voss | B60T 8/363 303/119.2 |
| 2005/0178991 | A1 * | 8/2005 | Goossens | B60T 8/363 251/129.07 |
| 2006/0017033 | A1 * | 1/2006 | Voss | B60T 8/363 251/129.19 |
| 2007/0001142 | A1 * | 1/2007 | Kratzer | B60T 8/363 251/129.18 |
| 2007/0251503 | A1 * | 11/2007 | Buehner | F02M 61/14 123/470 |
| 2009/0278067 | A1 * | 11/2009 | Voss | B60T 8/363 251/129.15 |
| 2010/0252763 | A1 * | 10/2010 | Courth | B60T 8/367 251/129.15 |
| 2010/0264342 | A1 * | 10/2010 | Heyer | B60T 8/363 251/129.15 |
| 2011/0186760 | A1 * | 8/2011 | Michl | B60T 8/363 251/129.15 |
| 2011/0198522 | A1 * | 8/2011 | Ambrosi | B60T 8/363 251/129.15 |
| 2011/0204271 | A1 * | 8/2011 | Kratzer | B60T 8/363 251/129.15 |
| 2012/0313022 | A1 * | 12/2012 | Godbillon | B60T 8/363 251/129.15 |
| 2012/0319722 | A1 | 12/2012 | Zhang et al. | |
| 2013/0146796 | A1 * | 6/2013 | Karl | B60T 8/363 251/129.15 |
| 2014/0103243 | A1 * | 4/2014 | Van Himme | F04B 7/0076 251/319 |
| 2015/0048268 | A1 * | 2/2015 | Voss | F16K 31/0658 251/129.07 |
| 2015/0083948 | A1 * | 3/2015 | Bleeck | F02M 63/0031 251/129.19 |
| 2015/0102242 | A1 * | 4/2015 | Timmermans | F16K 31/0675 251/129.07 |
| 2015/0226168 | A1 * | 8/2015 | Fruth | F02M 63/0017 239/585.4 |
| 2015/0345449 | A1 * | 12/2015 | Gugel | F02M 63/0036 251/129.01 |
| 2018/0347528 | A1 * | 12/2018 | Cichon | B60T 8/363 251/129.02 |

FOREIGN PATENT DOCUMENTS

| | | | | |
|---|---|---|---|---|
| DE | 102008035332 | | 2/2010 | |
| DE | 102013220593 | | 4/2015 | |
| DE | 102014200339 | | 7/2015 | |
| DE | 102014200339 | A1 * | 7/2015 | F02M 59/367 |
| DE | 102014202334 | | 8/2015 | |
| FR | 2956715 | A1 | 8/2011 | |
| WO | WO-2016058776 | A1 * | 4/2016 | F02M 59/367 |
| WO | WO-2017001092 | A1 * | 1/2017 | F02M 59/367 |

OTHER PUBLICATIONS

Zhang, et al., "Fault diagnosis of automotive electric power generation and storage systems", Control Applications (CCA), 2010 IEEE International Conference On, IEEE, Piscataway, NJ, USA, Sep. 8, 2010, pp. 719-724, XP031781827.

* cited by examiner

ELECTROMAGNETICALLY ACTUATABLE INLET VALVE AND HIGH-PRESSURE PUMP HAVING AN INLET VALVE

BACKGROUND OF THE INVENTION

The invention relates to an electromagnetically actuable inlet valve for a high-pressure pump, in particular of a fuel injection system. The invention also relates to a high-pressure pump having such an inlet valve.

An electromagnetically actuable inlet valve for a high-pressure pump of a fuel injection system is known from DE 10 2013 220 593 A1. The high-pressure pump has at least one pump element having a pump piston which is driven in a reciprocating movement and which delimits a pump working chamber. The pump working chamber is able to be connected to an inflow for the fuel via the inlet valve. The inlet valve comprises a valve member which interacts with a valve seat for the purpose of control and which is able to be moved between an open position and a closed position. In its closed position, the valve member comes to bear against the valve seat. The inlet valve also comprises an electromagnetic actuator by way of which the valve member is able to be moved. The electromagnetic actuator has a magnet armature which acts at least indirectly on the valve member, a magnet coil which surrounds the magnet armature, and a magnet core. The magnet armature is guided in a displaceable manner in a carrier element, wherein the carrier element and the magnet core are connected to one another. When the magnet coil is energized, the magnet armature is able to be moved counter to the force of a restoring spring and comes to bear at least indirectly against the magnet core. A spacing element composed of non-magnetic material can be arranged between the magnet armature and the magnet core in order to ensure a residual air gap and to avoid magnetic adhesion of the magnet armature to the magnet core. When the magnet armature strikes against the magnet core, the result can be high loads on both of these components and on the connection between these two components, which, over a relatively long operating duration, can lead to damage to the two components and/or to the connection therebetween, as a consequence of which the functional capacity of the inlet valve can be compromised.

SUMMARY OF THE INVENTION

By contrast, the inlet valve according to the invention has the advantage that the connection between the carrier element and the magnet core is able to accommodate high loads, and therefore a long operating duration of the inlet valve and thus the high-pressure pump without any damage is made possible. Due to the second connection region with the form-fitting connection, the first connection region with the materially bonded connection is relieved of load and the durability of the latter is thus improved.

One embodiment of the invention results in the form-fitting connection in the second connection region being made possible in a simple manner. Another embodiment results in particularly effective load relief for the materially bonded connection of the first connection region being made possible.

BRIEF DESCRIPTION OF THE DRAWINGS

Two exemplary embodiments of the invention will be described in more detail below on the basis of the appended drawing.

DETAILED DESCRIPTION

Figure 1:
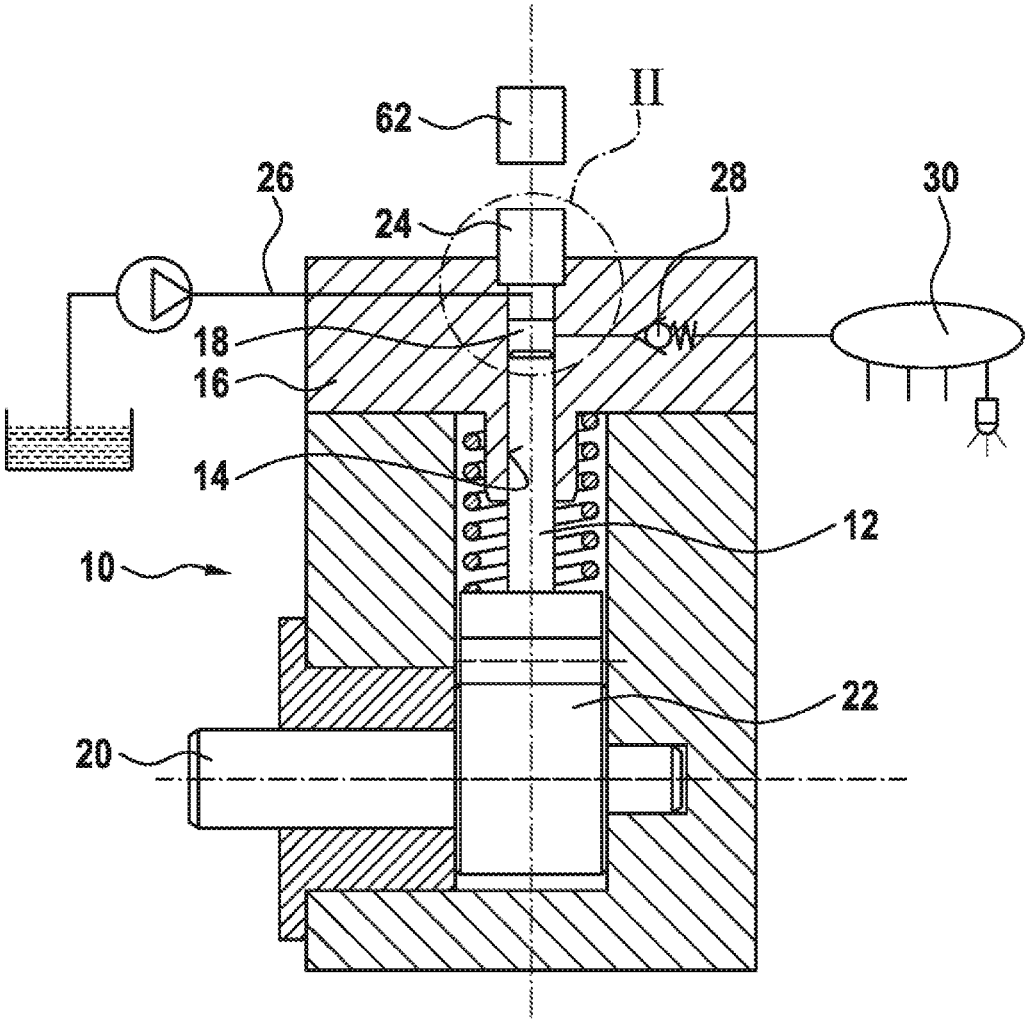
FIG. 1 shows a schematic longitudinal section through a high-pressure pump.

FIG. 1 partially illustrates a high-pressure pump which is provided in a fuel injection system of an internal combustion engine for the purpose of delivering fuel. The high-pressure pump has at least one pump element 10, this in turn having a pump piston 12 which is driven in a reciprocating movement by a drive, is guided in a cylinder bore 14 of a housing part 16 of the high-pressure pump, and delimits a pump working chamber 18 in the cylinder bore 14. As the drive for the pump piston 12, it is possible to provide a drive shaft 20 having a cam 22 or eccentric against which the the pump piston 12 is supported directly or via a tappet, for example a roller tappet. The pump working chamber 18 is able to be connected to a fuel inflow 26 via an inlet valve 24 and to an accumulator 30 via an outlet valve 28. During the suction stroke of the pump piston 12, the pump working chamber 18 can be filled with fuel when the inlet valve 24 is open. During the delivery stroke of the pump piston 12, fuel is displaced out of the pump working chamber 18, and delivered into the accumulator 30, by said piston.

Figure 2:
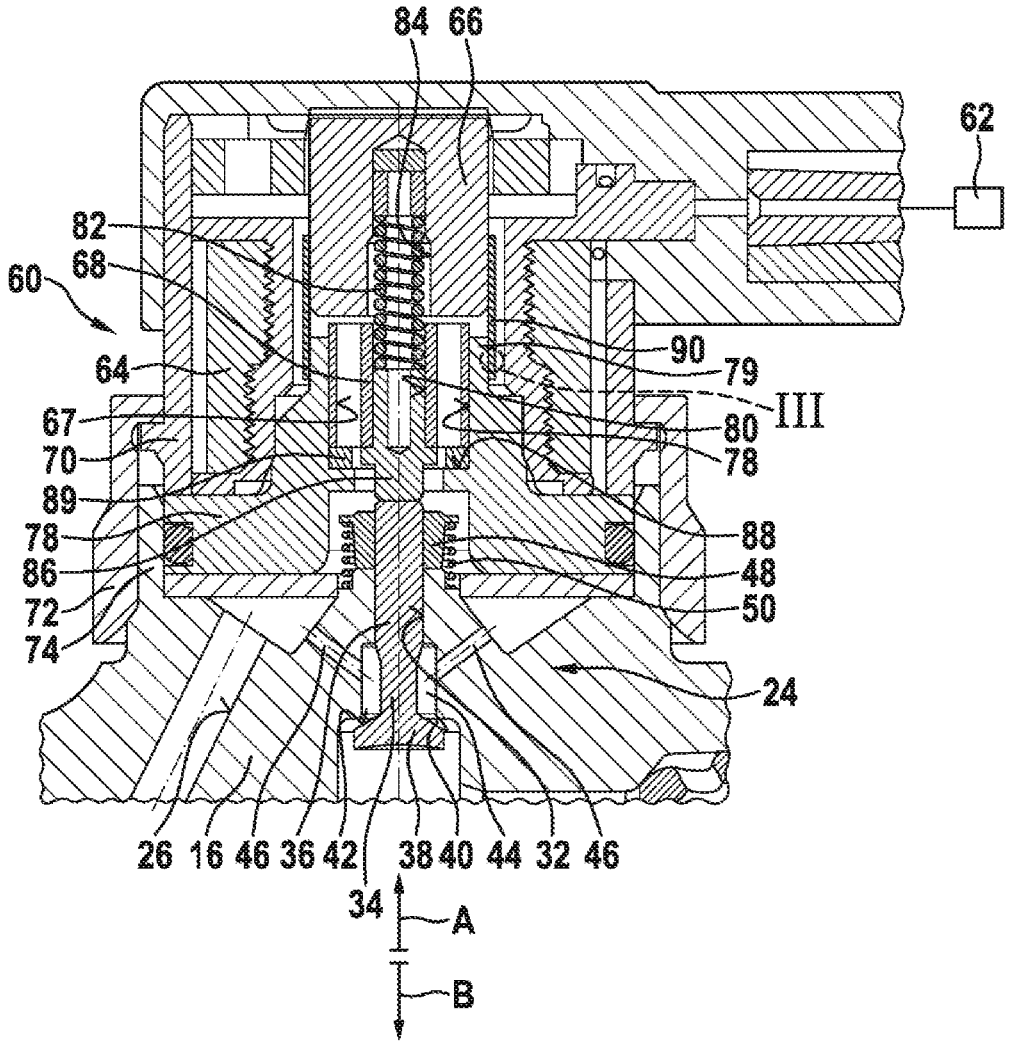
FIG. 2 shows, on an enlarged scale, a detail, denoted by II in FIG. 1, with the inlet valve of the high-pressure pump.

As illustrated in FIG. 2, the cylinder bore 14 is adjoined, on that side thereof which faces away from the pump piston 12, in the housing part 16 of the high-pressure pump by a through bore 32 which has a smaller diameter than the cylinder bore 14 and which opens at the outer side of the housing part 16. The inlet valve 24 has a piston-like valve member 34 having a shaft 36 which is guided in a displaceable manner in the through bore 32 and having a head 38 which, in diameter, is larger in comparison with the shaft 36 and which is arranged in the pump working chamber 18. At the transition from the cylinder bore 14 to the through bore 32 there is formed on the housing part 16 a valve seat 40 with which the valve member 34 interacts by way of a sealing surface 42 which is formed on the head 38 of said member.

In a section adjacent to the valve seat 40, the through bore 32 has a larger diameter than in that section of said bore which guides the shaft 36 of the valve member 34, with the result that an annular chamber 44 surrounding the shaft 36 of the valve member 34 is formed. One or more inflow bores 46 open into the annular chamber 44 and, on the other side, open at the outer side of the housing part 16.

The shaft 36 of the valve member 34 projects out of the through bore 32 on that side of the housing part 16 which faces away from the pump working chamber 18, and a support element 48 is fastened to said shaft. Supported against the support element 48 is a valve spring 50 which, on the other side, is supported against a region 52 of the housing part 16, which region surrounds the shaft 36 of the valve member 34. The valve member 34 is loaded in a setting direction A in its closing direction by the valve spring 50, wherein, in its closed position, the valve member 34 bears by way of its sealing surface 42 against the valve seat 40. The valve spring 50 is formed for example as a helical compression spring.

The inlet valve 24 is able to be actuated by way of an electromagnetic actuator 60, which is in particular illustrated in FIG. 2. The actuator 60 is activated by way of an electronic control device 62 in dependence on operating parameters of the internal combustion engine which is to be provided with a supply. The electromagnetic actuator 60 has a magnet coil 64, a magnet core 66 and a magnet armature 68. The electromagnetic actuator 60 is arranged on that side of the inlet valve 24 which faces away from the pump working chamber 18. The magnet core 66 and the magnet coil 64 are arranged in an actuator housing 70 which is able to be fastened to the housing part 16 of the high-pressure pump. The actuator housing 70 is, for example, able to be fastened to the housing part 16 by means of one of these over-engaging screw rings 72 which is screwed on a collar 74, provided with an outer thread, of the housing part 16.

The magnet armature 68 is at least of substantially cylindrical form and is guided in a displaceable manner via its outer casing in a bore 76 in a carrier element 78 arranged in the actuator housing 70. The bore 76 in the carrier element 78 extends at least approximately coaxially with respect to the through bore 32 in the housing part 16 and thus with respect to the valve member 34. The carrier element 78 has a cylindrical outer shape in its end region 79 which faces away from the housing part 16. The magnet core 66 is arranged in the actuator housing 70 on that side of the carrier element 78 which faces away from the housing part 16 and has a cylindrical outer shape.

The magnet armature 68 has a central bore 80 which is arranged at least approximately coaxially with respect to the longitudinal axis 69 of the magnet armature 68 and into which a restoring spring 82 projects, which spring is arranged on that side of the magnet armature 68 which faces away from the valve member 34 and is supported against the magnet armature 68. At its other end, the restoring spring 82 is at least indirectly supported against the magnet core 66, which has a central bore 84 into which the restoring spring 82 projects. A support element 85 for the restoring spring 82 may be inserted, for example pressed, in the bore 84 of the magnet armature 66. An intermediate element 86, which may be formed as an armature pin, is inserted into the central bore 80 of the magnet armature 68. The armature pin 86 is preferably pressed into the bore 80 of the magnet armature 68. It is also possible for the restoring spring 82 to be supported in the bore 80 against the armature pin 86. The magnet armature 68 may have one or more through openings 67.

An annular shoulder 88 by way of which the movement of the magnet armature 68 toward the inlet valve 24 is limited is formed in the bore 76 due to a reduction in diameter between the magnet armature 68 and the inlet valve 24. If the actuator housing 70 is not yet fastened to the housing part 16 of the high-pressure pump, then the magnet armature 68 is secured against falling out of the bore 76 by the annular shoulder 88. A disk 89 may be arranged between the annular shoulder 88 and the magnet armature 68.

The carrier element 78 and the magnet core 66 are connected to one another by means of a sleeve-like connection element 90. The connection element 90 is in this case arranged with its one axial end region 90*a* on the cylindrical section 79 of the carrier element 78 and connected thereto, and is arranged with its other axial end region 90*b* on the cylindrical magnet core 66 and connected thereto. The connection element 90 is, in a middle region 90*c* arranged between its axial end regions 90*a*, 90*b*, connected neither to the carrier element 78 nor to the magnet core 66 and bridges an axial spacing between the carrier element 78 and the magnet core 66.

Figure 3:
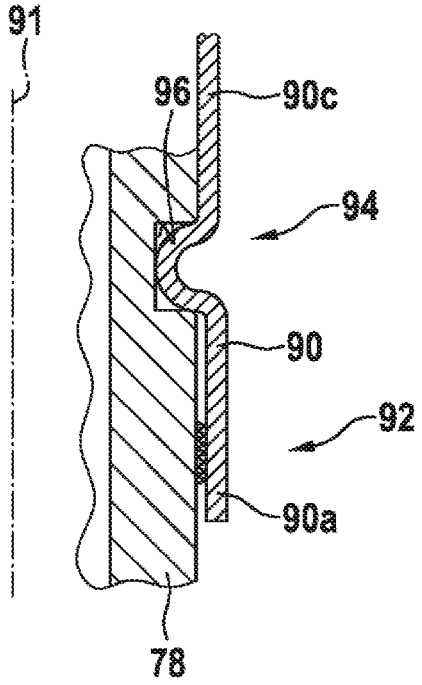
FIG. 3 shows, on a further-enlarged scale, a detail, denoted by III in FIG. 2, with connection regions of a connection element.

As illustrated in FIG. 3, the connection of the connection element 90 to the carrier element 78 and/or to the magnet core 66 comprises in each case two connection regions 92 and 94 which are arranged offset from one another in the direction of the longitudinal axis 91 of the connection element 90. In the first connection region 92, the connection element 90 is connected in a materially bonded manner to the carrier element 78 and/or to the magnet core 66. The materially bonded connection in the first connection region 92 may in particular be a welded connection. The welded connection in the first connection region 92 is preferably formed so as to be completely closed over the circumference of the connection element 90, with the result that the sealing of the transition between the carrier element 78 and the magnet core 66 is ensured by said connection.

In the second connection region 94, the connection element 90 is connected in a form-fitting manner to the carrier element 78 and/or to the magnet core 66. In the second connection region 94, the carrier element 78 and/or the magnet core 66 has in its outer casing a depression 96 which is formed in particular as a bead extending over the circumference of the carrier element 78 and/or of the magnet core 66. In order to establish the form-fitting connection, the connection element 90 is pushed into the depression 96 while being plastically deformed. For the plastic deformation of the connection element 90 into the depression 96, it is possible for use to be made of a stamping or pressing tool by way of which the connection element 90 is pushed radially with respect to its longitudinal axis 91. The depression 96 may be formed to be relatively sharp-edged on its edges on the outer casing of the carrier element 78 and/or of the magnet core 66 in order to allow a secure form fit of the connection element 90.

The form-fitting connection of the connection element 90 in the second connection region 94 results in the loading of the materially bonded connection of the connection element 90 in the first connection region 92 being reduced since, in the second connection region 94, part of the forces which arise is absorbed in the direction of the longitudinal axis 91 of the connection element 90. FIG. 3 illustrates only the connection of the connection element 90 to the carrier element 78, wherein alternatively or additionally, the connection of the connection element 90 to the magnet core 66 is realized.

It may be provided that, during the connection of the connection element 90 to the carrier element 78 and to the magnet core 66, firstly the form-fitting connection, for example in the form of the welded connection, is realized in the first connection region 92. Subsequently, the connection element 90 is preloaded by applying a tensile force in the direction of its longitudinal axis 91, and, in this preloaded state, the plastic deformation of the connection element 90 into the depression 96 is realized for the purpose of establishing the form-fitting connection in the second connection region 94. The tensile force is then removed again, wherein a preload in the connection element 90 is maintained between the first connection region 92 and the second connection region 94. Due to this preload, it can be achieved that, for the first connection region 92 with the materially bonded connection, only a pulsating load is obtained during operation and no alternating load, as would be the case without preloading.

Figure 4:
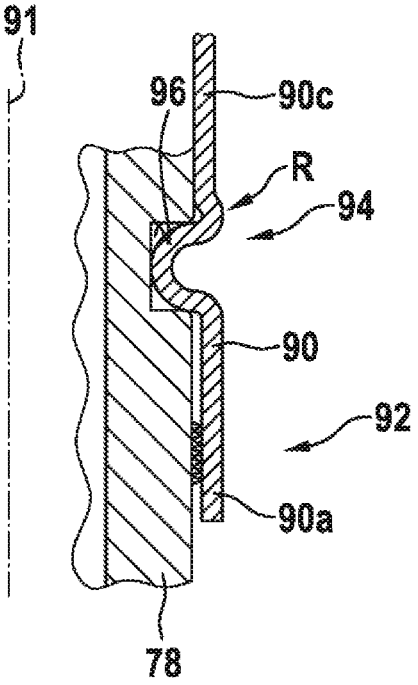
FIG. 4 shows a variant of the connection element.

It may additionally be provided that the connection element 90 is, sectionally, able to be elastically deformed in the direction of its longitudinal axis 91. As illustrated in FIG. 4, elastic deformability of the connection element 90 may be achieved for example in that, in the second connection region 94, during the plastic deformation of the connection element 90 into the depression 96 by the stamping or pressing tool, a bulge of the connection element 90, for example having a radius R, is produced at the transition from the depression 96 to the outer casing of the carrier element 78 and/or of the magnet core 66. Due to the bulge, the connection element 90 has, adjacent to the second connection region 94, a section in which said element is able to be elastically deformed in the direction of its longitudinal axis 91.

The function of the electromagnetically actuable inlet valve 24 will be discussed below. During the suction stroke of the pump piston 12, the inlet valve 24 is open in that its valve member 34 is situated in its open position, in which said member is arranged such that its sealing surface 42 is at a distance from the valve seat 40. The movement of the valve member 34 into its open position is brought about by the pressure difference prevailing between the fuel inflow 26 and the pump working chamber 18 counter to the force of the valve spring 50. The magnet coil 64 of the actuator 60 can in this case be energized or deenergized. If the magnet coil 64 is energized, then, due to the magnetic field which forms, the magnet armature 68 is pulled toward the magnet core 66 counter to the force of the restoring spring 82. If the magnet coil 64 is not energized, then the magnet armature 68 is pushed toward the inlet valve 24 by the force of the restoring spring 82. The magnet armature 68 bears against the end face of the shaft 36 of the valve member 34 via the armature pin 86.

During the delivery stroke of the pump piston 12, it is determined by the actuator 60 whether the valve member 34 of the inlet valve 24 is situated in its open position or closed position. When the magnet coil 64 is deenergized, the magnet armature 68 is pushed by the restoring spring 82 in the setting direction as per arrow B in FIG. 2, wherein the valve member 34 is pushed by the magnet armature 68 counter to the valve spring 50 in the setting direction B into its open position. The force of the restoring spring 82 acting on the magnet armature 68 is larger than the force of the valve spring 50 acting on the valve member 34. The magnet armature 68 acts on the valve member 34 in the setting direction B, and the magnet armature 68 and the valve member 34 are jointly moved in the setting direction B. As long as the magnet core 64 is not energized, fuel is thus no longer able to be delivered by way of the pump piston 12 into the accumulator 30, but rather fuel displaced by the pump piston 12 is delivered back into the fuel inflow 26. If during the delivery stroke of the pump piston 12, fuel is to be delivered into the accumulator 30, then the magnet coil 64 is energized, with the result that the magnet armature 68 is pulled toward the magnet core 66 in a setting direction as per arrow A in FIG. 2, which direction is opposite to setting direction B. Force is thus no longer exerted on the valve member 34 by the magnet armature 68, wherein the magnet armature 68 is moved by way of the magnetic field in the setting direction A, and the valve member 34 is moved in the setting direction A into its closed position, independently of the magnet armature 68, due to the valve spring 50 and the pressure difference prevailing between the pump working chamber 18 and the fuel inflow 26.

It is possible for the delivery quantity of the high-pressure pump in the accumulator 30 to be set in a variable manner by way of the opening of the inlet valve 34 during the delivery stroke of the pump piston 12 by means of the electromagnetic actuator 60. If a small delivery quantity of fuel is required, then the inlet valve 34 is held open by way of the actuator 60 during a large part of the delivery stroke of the pump piston 12, and if a large delivery quantity of fuel is required, then the inlet valve 34 is held open only during a small part of, or not at all during, the delivery stroke of the pump piston 12.

What is claimed is:

1. An electromagnetically actuable inlet valve (24) for a high-pressure pump, the inlet valve comprising:

a valve member (34) which is configured to be moved between an open position and a closed position, and having an electromagnetic actuator (60) by way of which the valve member (34) is moved, wherein the electromagnetic actuator (60) has a magnet armature (68) which is configured to move the valve member (34), a magnet coil (64) which surrounds the magnet armature (68), and a magnet core (66), wherein the magnetic armature (68) is configured to be moved toward the magnetic core (66) when the magnet coil (64) is energized, wherein the magnet armature (68) is guided in a displaceable manner in a carrier element (78), and wherein the carrier element (78) and the magnet core (66) are connected to one another, characterized in that the carrier element (78) and the magnet core (66) are connected to one another via a sleeve-like connection element (90), wherein the sleeve-like connection element (90) is connected to the carrier element (78) in a materially bonded manner in a first connection region (92) and in a form-fitting manner in a second connection region (94) which is offset from the first connection region (92) in a direction of a longitudinal axis (91) of the connection element (90), wherein the connection element (90) has a preload in the direction of its longitudinal axis (91) between the first connection region (92) and the second connection region (94).

2. The inlet valve as claimed in claim 1, characterized in that the first connection region (92) is arranged in an end region, as viewed in the direction of the longitudinal axis (91), of the connection element (90), and in that the second connection region (94) is offset toward a center of the connection element (90) in relation to the first connection region (92).

3. The inlet valve as claimed in claim 1, characterized in that the carrier element (78) has in an outer casing at least one depression (96) into which the connection element (90) enters, while the connection element is plastically deformed, for the purpose of the form-fitting connection.

4. The inlet valve as claimed in claim 3, characterized in that the at least one depression (96) is formed as a circumferential bead.

5. The inlet valve as claimed in claim 1, characterized in that the preload is a tensile preload in the direction of the longitudinal axis (91) between the first connection region (92) and the second connection region (94).

6. The inlet valve as claimed in claim 1, characterized in that the connection element (90) is configured to be elastically deformed in the direction of its longitudinal axis (91) in a section adjacent to the second connection region (94).

7. The inlet valve as claimed in claim 1, characterized in that the materially bonded connection of the connection element (90) to the carrier element (78) in the first connection region (92) is a welded connection.

8. A high-pressure pump comprising the inlet valve (24) as claimed in claim 1, and at least one pump element (10) which has a pump piston (12) that delimits a pump working chamber (18), wherein the pump working chamber (18) is configured to be connected to an inflow (26) via the inlet valve (24).

9. A method of forming the inlet valve as claimed in claim 1, the method comprising:

welding the connection element (90) to the carrier element (78) at the first connection region (92); and subsequent to welding, applying a tensile force in the direction of the longitudinal axis and then plastically deforming the connection element (90) into a depression (96) of the carrier element (78) at the second connection region (94), so as to form the preload.

10. An electromagnetically actuable inlet valve (24) for a high-pressure pump, the inlet valve comprising:

a valve member (34) which is configured to be moved between an open position and a closed position, and having an electromagnetic actuator (60) by way of which the valve member (34) is moved, wherein the electromagnetic actuator (60) has a magnet armature (68) which is configured to move the valve member (34), a magnet coil (64) which surrounds the magnet armature (68), and a magnet core (66), wherein the magnetic armature (68) is configured to be moved toward the magnetic core (66) when the magnet coil (64) is energized, wherein the magnet armature (68) is guided in a displaceable manner in a carrier element (78), and wherein the carrier element (78) and the magnet core (66) are connected to one another, characterized in that the carrier element (78) and the magnet core (66) are connected to one another via a sleeve-like connection element (90), wherein the sleeve-like connection element (90) is connected to the magnet core (66) in a materially bonded manner in a first connection region (92) and in a form-fitting manner in a second connection region (94) which is offset from the first connection region (92) in a direction of a longitudinal axis (91) of the connection element (90), wherein the connection element (90) has a preload in the direction of its longitudinal axis (91) between the first connection region (92) and the second connection region (94).

11. The inlet valve as claimed in claim 10, characterized in that the first connection region (92) is arranged in an end region, as viewed in the direction of the longitudinal axis (91), of the connection element (90), and in that the second connection region (94) is offset toward a center of the connection element (90) in relation to the first connection region (92).

12. The inlet valve as claimed in claim 10, characterized in that the magnet core (66) has in an outer casing at least one depression (96) into which the connection element (90) enters, while the connection element is plastically deformed, for the purpose of the form-fitting connection.

13. The inlet valve as claimed in claim 12, characterized in that the at least one depression (96) is formed as a circumferential bead.

14. The inlet valve as claimed in claim 10, characterized in that the connection element (90) is configured to be elastically deformed in the direction of its longitudinal axis (91) in a section adjacent to the second connection region (94).

15. The inlet valve as claimed in claim 10, characterized in that the materially bonded connection of the connection element (90) to the magnet core (66) in the first connection region (92) is a welded connection.

16. The inlet valve as claimed in claim 10, wherein the connection element (90) is further connected to the carrier element (78) in a materially bonded manner in a third connection region (92) and in a form-fitting manner in a fourth connection region (94) which is offset from the third connection region (92) in a direction of a longitudinal axis (91) of the connection element (90).

17. The inlet valve as claimed in claim 16, wherein the first connection region (92) on the magnet core (66) is a welded connection, wherein the second connection region (94) on the magnet core (66) is a plastic deformation of the connection element (90) into a depression (96) in the magnet core (66) so as to form the preload between the first connection region (92) on the magnet core (66) and the second connection region (94) on the magnet core (66), wherein the third connection region (92) on the carrier element (78) is a welded connection, wherein the fourth connection region (94) on the carrier element (78) is a plastic deformation of the connection element (90) into a depression (96) in the carrier element (78) so as to form a further preload between the third connection region (92) on the carrier element (78) and the fourth connection region (94) on the carrier element (78).

18. The inlet valve as claimed in claim 17, wherein the second connection region and the third connection region are each disposed axially between the first connection region and the fourth connection region.

19. The inlet valve as claimed in claim 10, wherein the preload is a tensile preload in the direction of the longitudinal axis (91) between the first connection region (92) and the second connection region (94).

20. A high-pressure pump comprising the inlet valve (24) as claimed in claim 10, and at least one pump element (10) which has a pump piston (12) that delimits a pump working chamber (18), wherein the pump working chamber (18) is configured to be connected to an inflow (26) via the inlet valve (24).

21. A method of forming the inlet valve as claimed in claim 10, the method comprising:

welding the connection element (90) to the magnet core (66) at the first connection region (92); and subsequent to welding, applying a tensile force in the direction of the longitudinal axis and then plastically deforming the connection element (90) into a depression (96) of the magnet core (66) at the second connection region (94), so as to form the preload.

* * * * *